US005258814A

United States Patent [19]

Davies

[11] Patent Number: 5,258,814

[45] Date of Patent: Nov. 2, 1993

[54] TONER CARTRIDGE SEAL

[76] Inventor: Wilkins L. Davies, P.O. Box 4806, Clearwater, Fla. 34618

[21] Appl. No.: 896,318

[22] Filed: Jun. 10, 1992

[51] Int. Cl.[5] ..... G03G 15/06; G03G 21/00

[52] U.S. Cl. ..... 355/260; 222/DIG. 1; 355/245

[58] Field of Search ..... 355/215, 245, 260; 222/DIG. 1, 542; 277/1, 9, 11, 12; 141/363-366; 206/527

[56] References Cited

U.S. PATENT DOCUMENTS

| | | | |
|---|---|---|---|
| 4,495,690 | 1/1985 | McNeal | 277/1 X |
| 4,816,877 | 3/1989 | Keen | 222/DIG. 1 |
| 4,862,210 | 8/1989 | Woolley | 355/245 |
| 4,930,684 | 6/1990 | Patterson | 222/DIG. 1 X |
| 5,080,745 | 1/1992 | Paull | 355/260 X |
| 5,110,646 | 5/1992 | Prestel et al. | 355/260 X |
| 5,184,182 | 2/1993 | Michlin | 355/260 |

*Primary Examiner*—A. T. Grimley
*Assistant Examiner*—William J. Royer
*Attorney, Agent, or Firm*—D. A. Kiewit

[57] ABSTRACT

A composite seal for preventing leakage of dry toner material from a toner hopper of a toner cartridge is made by interposing a resilient material between two generally smooth elongated rectangular sheets that have slightly different widths. This construction of the seal allows it to be pushed into thin entry slots, but also to expand to fill and seal a pre-existing channel between the toner hopper and the rest of the cartridge. The seal is most advantageously inserted into the cartridge by using a tool formed from two thin sheets of material that have curved ends.

7 Claims, 2 Drawing Sheets

TONER CARTRIDGE SEAL

BACKGROUND OF THE INVENTION

This invention provides apparatus and method for re-sealing a toner hopper that is a part of a toner cartridge used in a dry toner printer or photocopying machine.

Recent developments in the electrostatic printing industry have led to the introduction of dry toner cartridges for use in relatively low cost computer printers and photocopying machines. These cartridges are intended by their manufacturers to be disposable, but have a sufficiently high replacement cost that a "recharging" industry has grown to provide reloaded and rebuilt cartridges. Thus, a nominally disposable cartridge may, during its service life, be recharged with new toner material multiple times.

It is customary for the original manufacturer of a printer or copying machine cartridge to fill the toner hopper with toner prior to completing the assembly of the unit and to seal the filled toner hopper with a plastic sheet that is suitably secured (e.g. by welding) to a flange at the top of the toner hopper. The sealed toner hopper is then assembled with the balance of the toner cartridge elements (e.g. by welding the two longer of the four edges of the flange at the top of the toner hopper to a mating flange on a roller housing subassembly), thereby forming a channel wherein lies the plastic sealing sheet. The user, immediately before installing the cartridge, grasps a tab portion of the plastic sealing sheet and pulls the sheet out of the channel, thereby opening the hopper and allowing toner to be metered out of the hopper onto a receiving surface.

Several earlier inventors have sought to provide method and apparatus for sealing the toner hopper from the balance of the toner cartridge during a recharging operation. Absent such a seal, toner is almost invariably spilled from the cartridge when the recharged cartridge is shipped. Notable among the prior art is the teaching of Woolley in U.S. Pat. No. 4,862,210, which is primarily directed toward toner cartridges made by the Canon Corporation. Woolley's replacement seal is made by partially disassembling a toner cartridge that is to be recharged for the first time, fastening brackets in the channel that was initially occupied by the plastic sealing sheet so as to form an improved channel of well-defined geometry, and then inserting a generally rigid sealing member into the improved channel. During subsequent recharging operations the toner cartridge does not need to be partially disassembled, as a seal can be inserted into the improved channel through a slot at one end of the toner cartridge. The disclosure of Woolley is herein incorporated by reference.

Patterson, in U.S. Pat. No. 4,930,684, teaches a closure strip and method for remanufacturing a toner cartridge of the same sort as was addressed by Woolley. The closure strip of Patterson includes a firm substrate member of a width slightly less than the distance between the walls of the channels running the length of the toner cartridge and a length somewhat longer than the toner cartridge so that a portion of the substrate sticks out through the slot in the end of the toner cartridge. Thus, the seal can be grasped and easily removed. A resilient sealing element is attached to one face of the substrate member and is intended to fit snugly between the hopper flange and the roller housing subassembly flange portions of the interior channels that were formed in the cartridge during its original manufacture. It has been found that Patterson's seal is difficult to insert in the narrow slots that are present in the ends of commercially available cartridges, because the resilient element of the seal tends to hang up on the edges of the slot. If the resilient material is torn by the edges of the slot, it provides a less than totally effective seal. The disclosure of Patterson is herein incorporated by reference.

Another prior art approach to providing a toner cartridge seal during recharging involves disassembling the cartridge, cleaning both flanges, and securing a plastic sheet over the toner hopper—i.e. duplicating the sealing method used by the original manufacture. This approach, aside from the obvious difficulty posed by disassembly and reassembly of a welded structure, also requires extreme cleanliness, which may be relatively easy to provide in a factory that is handling virgin materials, but which is very difficult to provide in a recharging environment.

Yet another prior art sealing approach uses a rigid sealing sheet with a magnetized layer on one side thereof. Since the dry toner powder is ferromagnetic, this layer is supposed to keep enough toner attracted to the sheet to give the sheet an effective thickness large enough to seal the channel.

SUMMARY OF THE INVENTION

It is an object of this invention to provide apparatus and method for re-sealing re-filled dry toner cartridges so that the cartridges can be shipped from one location to another without spilling the toner.

It is a further object of the invention to provide a toner cartridge seal that has compliant sealing edges that will fit the uneven pre-existing surfaces of a channel between the toner hopper and roller housing portions of a toner cartridge and thereby effectively seal the toner hopper.

It is an additional object of the invention to provide a toner cartridge seal that can be inserted into a used toner cartridge without having to disassemble that cartridge.

It is a further object of the invention to provide a toner cartridge seal that is not easily damaged during the process of inserting the seal into the cartridge.

It is yet a further object of the invention to provide method and apparatus for inserting a toner hopper seal so as to ensure that the seal extends the full length of the toner cartridge.

DESCRIPTION OF THE PREFERRED EMBODIMENT

Figure 1:
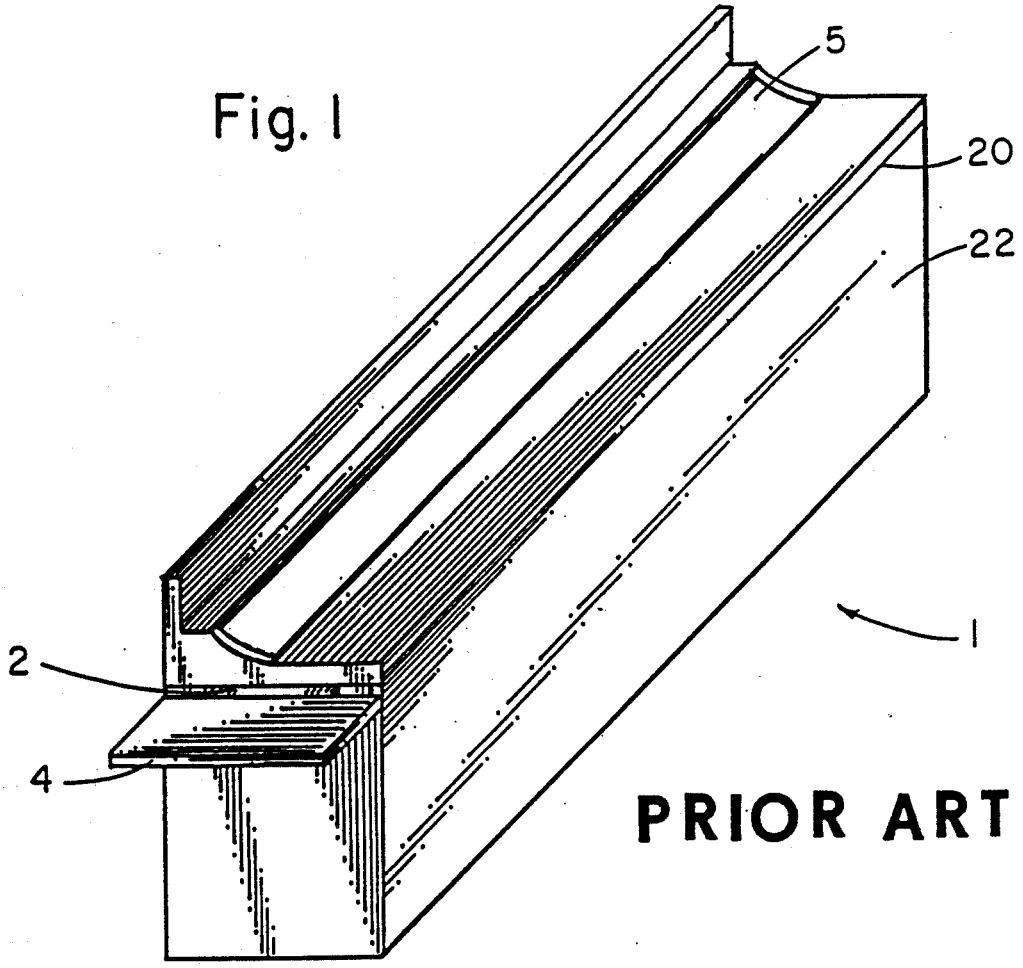
FIG. 1 of the drawings is an isometric view of a dry toner hopper, showing a slot at one end of the channel formed between the toner hopper and roller subassembly portions of the toner cartridge.

FIG. 1 of the drawings provides a schematic rendering of a commercially available dry toner cartridge 1, comprising a toner hopper 22 and a roller housing subassembly 5 joined along a seam 20. Generally irregular channels, not indicated in FIG. 1, but known from the disclosures of Woolley and of Patterson, are formed on the interior part of the cartridge and run along the seam 20. A slot 2 in one end of the cartridge is opened when the original factory seal is withdrawn. A corresponding slot (not shown) is found at the opposite end of the cartridge 1. A bracket 4, is integrally formed with the toner hopper 22 and provides a means of holding the original factory seal in place.

Figure 2:
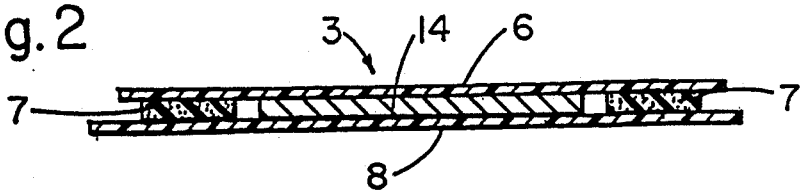
PRIOR ART Fig. 2
FIG. 2 of the drawings is a cross-sectional view of a seal.

Turning now to FIG. 2 of the drawings, one finds a cross-sectional view of an expandable seal 3 that is made by sandwiching a centrally disposed strip of stiffening material 14 and a peripheral strip of resilient material 7 between a top strip of material 6, and a bottom strip of material 8. As can be seen from FIG. 3, the thickness of the seal 3 can be changed by compressing the resilient material 7. Thus, the provision of resilient material 7 in the seal 3 makes it easier to insert the seal 3 into slot 2. Moreover, since the channels lying along the seam 20 are of irregular height, the resilient material 7 causes the seal to expand to fill the channel at all locations by forcing the two outer strips 6 and 8 against the toner hopper and roller subassembly flange portions that form surfaces of the channels. It has been found that setting the resilient material back approximately one sixteenth of an inch from the edge of the narrower outer strip 6 provides good results.

Figure 3:
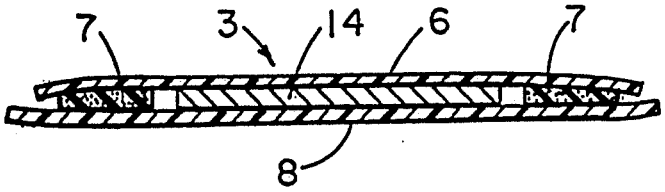
FIG. 3 of the drawings is cross-sectional view of the seal, similar to that of FIG. 2, but showing the change in shape that occurs when a resilient material in the seal is compressed.

The top outer strip 6 of the seal is preferably chosen to be narrower than is the bottom outer strip 8. This geometry is chosen to provide a minimal thickness at the edge of seal 3 (e.g. as shown in FIG. 3) so as to ease insertion of the seal 3 into the slot 2 at the end of the toner cartridge 1.

Figure 4:
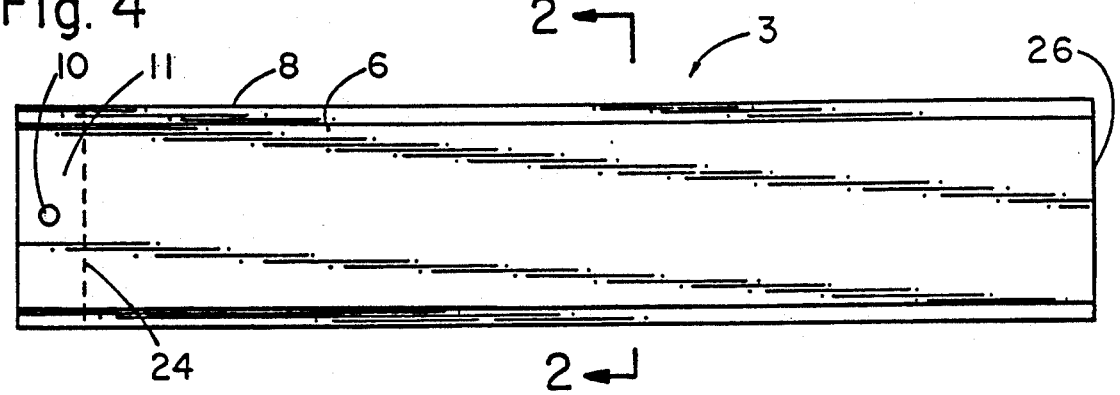
FIG. 4 of the drawings is a top view of the seal, showing a difference in width of two elongated strips from which the seal is made.

The seal 3 is necessarily longer than the toner cartridge 1. Turning to FIG. 4 of the drawings one finds a hand hold 11 portion that consists of that part of the seal that sticks out beyond the end of the toner cartridge (indicated as dashed line 24). The hand hold 11 is necessary for inserting or removing the seal 3. As a matter of convenience, one may choose to provide the hand hold 11 with a hole 10 that can be used to hang up the seal 3 when it is not in use.

Figure 5:
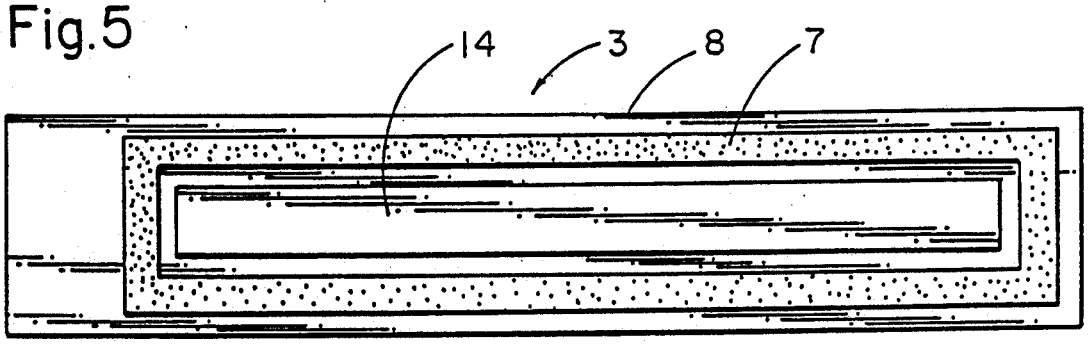
FIG. 5 of the drawings is a top plan view of a seal from which the narrower of the two outer strips has been removed to show the wider strip, a strip of stiffening material disposed along the longitudinal axis of the seal, and a peripheral strip of resilient material.

Turning now to FIG. 5 of the drawings, one finds an internal view of the seal 3 (i.e. as would be seen by peeling off one of the outer strips 6, 8) A stiffener 14 extends down the longitudinal axis of the seal 3 for most of its length, and may be surrounded by a peripheral band of resilient material 7, as shown in FIG. 5.

Figure 6:
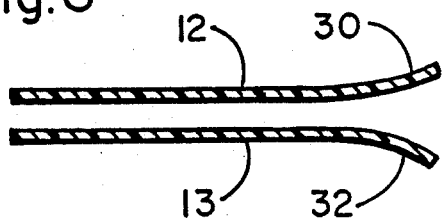
FIG. 6 of the drawings is a side view of two strips of material that form a tool used to aid in the insertion of the seal.

To be effective in preventing toner leakage from the hopper 22, the seal 3 extends from one end of the cartridge 1 to the other. That is, the seal 3 extends from the slot 2 in one end of the cartridge 1 to, or through, a corresponding slot formed in the other end of that cartridge. In order both to ensure that the seal 3 extends entirely through the cartridge 1, and to make the insertion process easier, two sheets of generally flexible material 12, 13, which are shown in an edge view in FIG. 6 of the drawing are used in the insertion process. Permanently curved end sections 30, 32 are formed in sheets 12 and 13. The two sheets 12, 13 are initially inserted, curved end sections 30, 32 foremost, with the curved sections generally curving away from each other (i.e. as shown in FIG. 6) into slot 2 in cartridge 1. The leading end 26 of the seal 3 can then be placed between the flat external ends of sheets 12 and 13 and pushed through the slot. This use of the two thin auxiliary sheets effectively smoothes the sometimes jagged edges of the slot and thereby eases insertion into the channel.

Once the leading end 26 of the seal 3 has been inserted into the slot 2, the thin sheets 12 and 13 are pulled out, and the seal is pushed partway into the channel. The thin curved sheets 12 and 13 are then inserted into the second slot at the opposite end of cartridge 1 from slot 2. Since the curved portions 30, 32 curve away from each other inside the channel, they offer an effectively wider and smoother slot at this far end of the insertion channel. The leading end of seal 3 is then pushed between the curved-apart sections 30, 32 of the two sheets 12, 13 and thence into the second slot. The flexible sheets 12, 13 are finally removed, leaving seal 3 installed in the cartridge 1 where it acts to prevent toner from leaking from the hopper 22.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed and desired to be secured by Letters Patent is:

1. A seal for sealing a toner cartridge, said cartridge having a first predetermined length and having a slot with a first predetermined width in an end thereof, said seal comprising a first elongated rectangular strip of material having a second length and a second width, said second length being greater than said first predetermined length of said cartridge and said second width being less than said first predetermined width of said slot, a second elongated rectangular strip of material having a third width, said third width being less than said second width and a strip of resilient material interposed between and adhered to said first and said second elongated rectangular strips, said strip of resilient material being disposed adjacent the periphery of said second elongated strip and spaced a predetermined distance from an edge of said second elongated strip, whereby said seal is adapted to be slid lengthwise into said slot.

2. A seal of claim 1 further comprising a rectangular strip of stiffening material interposed between and adhered to said first and said second elongated strips along a center line of said first elongated strip.

3. A seal of claim 1 wherein said resilient material is spaced one sixteenth of an inch from said edge of said second elongated strip.

4. A seal of claim 1 wherein said resilient material is a foam material.

5. A seal of claim 1 further comprising a rectangular strip of stiffening material interposed between and adhered to said first and said second elongated strips along a center line of said first elongated strip, and wherein said resilient material is a foam material that is spaced one sixteenth of an inch from said edge of said second elongated strip.

6. Apparatus for sealing a toner hopper of a toner cartridge, said cartridge having a first predetermined length, a first slot having a first predetermined width in an end thereof, said apparatus comprising a seal member consisting of a first elongated rectangular strip of material having a second length and a second width, said second length being greater than said first predetermined length of said cartridge and said second width being less than said first predetermined width of said slot, a second elongated rectangular strip of material having a third width, said third width being less than said second width and a strip of resilient material interposed between and adhered to said first and said second elongated rectangular strips, said strip of resilient material being disposed in the form of a hollow rectangle adjacent the periphery of said second elongated strip and spaced a predetermined distance from an edge of said second elongated strip, and a tool adapted for inserting said seal member into said slot, said tool comprising first and second flexible sheets, each said sheet having a curved section formed in an end thereof.

7. A method of inserting a seal into a toner cartridge so as to prevent toner material from leaking from a toner hopper, said method comprising the steps of inserting into a first slot in a first end of said toner cartridge a portion, including a curved end section, of a first and a second flexible sheet, said curved end sections being disposed so as to curve away from each other, inserting said seal between those portions of said first and said second flexible sheets that remain outside of said cartridge, pushing a portion of said seal into said cartridge, withdrawing said first and said second flexible sheets from said first slot, inserting into a second slot in a second end of said toner cartridge a portion, including a curved end section, of said first and said second flexible sheets, said curved end sections being disposed so as to curve away from each other, pushing said seal further into said cartridge so that a leading end of said seal passes between said first and said second sheets and thence through said second slot, and withdrawing said first and said second flexible sheets from said second slot.

* * * * *